United States Patent [19]

Okumura et al.

[11] 4,239,662

[45] Dec. 16, 1980

[54] LIQUID DETERGENT COMPOSITIONS

[75] Inventors: Osamu Okumura, Funabashi; Takenobu Sakatani; Toshinobu Kashiwada, both of Chiba; Kiyotaka Tokuyama, Funabashi, all of Japan

[73] Assignee: The Lion Fat and Oil Co., Ltd., Tokyo, Japan

[21] Appl. No.: 12,519

[22] Filed: Feb. 15, 1979

[30] Foreign Application Priority Data

Feb. 17, 1978 [JP] Japan ..... 53-17237

[51] Int. Cl.[3] ..... C11D 1/14; C11D 1/83

[52] U.S. Cl. ..... 252/555; 252/536; 252/550; 252/551; 252/554; 252/DIG. 14; 252/559

[58] Field of Search ..... 252/555, 536, 559, DIG. 14, 252/550, 551, 554

[56] References Cited

U.S. PATENT DOCUMENTS

Re. 27,096 3/1971 Walker ..... 252/555 X

*Primary Examiner*—Mayer Weinblatt

*Attorney, Agent, or Firm*—William J. Daniel

[57] ABSTRACT

An improved liquid detergent composition having a markedly decreased tendency toward film formation on the liquid surface when exposed to open air, without loss in detergency and foaming power.

This includes a magnesium α-olefinsulfonate, an alcohol-ethylene oxide addition product and magnesium sulfate, all in limited concentrations, the balance being an aqueous solvent and optional additives.

4 Claims, No Drawings

LIQUID DETERGENT COMPOSITIONS

BACKGROUND OF THE INVENTION

The present invention relates to a novel liquid detergent composition and, in particular, to an improved liquid detergent composition having excellent detergency and foaming power as well as a markedly reduced tendency toward film formation on the surface.

As is well known, various kinds of anionic surface active agents have been used hitherto as a main ingredient of liquid detergent compositions, among which magnesium α-olefinsulfonates is known to have excellent detergency and foaming power in comparison with other anionic surface active agents such as alkali metal salts or alkaline earth metal salts of linear alkylbenzenesulfonic acids and alkylethoxysulfuric acids.

One of the major problems in liquid detergent compositions containing a magnesium α-olefinsulfonate is, however, a tendency toward film formation on the surface of the liquid composition when exposed to open air, especially, when the total content of the surface active agents as the main ingredients is in the range of from 10 to 70% by weight and the content of the magnesium α-olefinsulfonate exceeds 5% by weight. In practical use of the liquid detergent compositions, such film formation often takes place, for example, when the liquid composition is left standing in a measuring cup or when the cap of the container is left removed and fresh air is allowed to contact with the liquid surface, and naturally causes some inconvenience in the subsequent use of the detergent composition. Moreover, the phenomenon of film formation on the surface presents a difficult problem in quality control in the manufacturing process.

In order to mitigate the above described problem of film formation on the surface, improved liquid detergent compositions containing a magnesium α-olefinsulfonate have been proposed, for example, in Japanese Pat. Nos. SHO 52-8009 and SHO 52-30807, according to which the magnesium α-olefinsulfonate is combined with certain kinds of nonionic surface active agents.

These liquid detergent compositions face, however, another problem in that, in addition to the undesirably high content of the nonionic surface active agents required for reducing the film-forming tendency, the desired performance characteristics of a detergent composition such as detergency or foaming power are inevitably degraded even though surface film formation itself is effectively prevented.

SUMMARY OF THE INVENTION

It is therefore an object of the present invention to present a novel and improved liquid detergent composition based on a magnesium α-olefinsulfonate having markedly reduced tendency toward film formation on the liquid surface, without impairment of its function or performance per se as a detergent composition.

The liquid detergent composition of the present invention formulated as a result of the intensive investigations undertaken by the inventors is based on the discovery that a liquid detergent composition containing a magnesium α-olefinsulfonate when combined with a specific nonionic surface active agent and magnesium sulfate in limited proportions and in limited concentrations in an aqueous solvent is very satisfactory in respect of the reduced film formation while remaining excellent in detergency and foaming power.

Thus, the liquid detergent composition of the invention essentially consists of (a) from 5 to 40% by weight of a magnesium α-olefinsulfonate having from 10 to 20 carbon atoms in a molecule, (b) from 1 to 8% by weight of an addition product of a primary alcohol having 3 to 13 carbon atoms in a molecule with 1 to 20 moles in an average of ethylene oxide or an addition product of a secondary alcohol having 9 to 18 carbon atoms in a molecule with 3 to 15 moles in an average of ethylene oxide, and (c) from 0.2 to 5% by weight of magnesium sulfate, the balance being an aqueous solvent and optional additives.

DETAILED DESCRIPTION OF THE PREFERRED EMBODIMENTS

In the following, the liquid detergent composition of the present invention is described in further detail.

The magnesium α-olefinsulfonate used as the component (a) in the inventive composition has desirably from 10 to 20 carbon atoms in its molecule and is prepared by sulfonating an α-olefin having 10 to 20 carbon atoms in a molecule, which is obtained by the method of wax cracking, the method of polymerization of ehtylene with a Ziegler catalyst and the like, while maintained in a thinly spread film with sulfuric anhydride diluted with an inert gas, followed by neutralization with magnesium oxide or magnesium hydroxide and hydrolysis. Alternatively, the magnesium α-olefinsulfonate can be obtained by the double decomposition reaction of its sodium α-olefinsulfonate having 10 to 20 carbon atoms in a molecule into the corresponding magnesium salt.

The magnesium α-olefinsulfonate thus prepared has preferably from 13.5 to 16.0 carbon atoms per molecule in an average and, more preferably, contains from 25 to 75% by weight of molecules having 14 carbon atoms. Besides, it should be noted that the magnesium α-olefinsulfonate obtained in the above method usually includes monosulfonates and disulfonates, the former of which can further be classified into alkenesulfonates and hydroxyalkanesulfonates, and it is particularly recommended that the ratio of alkenesulfonates to hydroxyalkanesulfonates is in the range from 40:60 to 90:10 or, more preferably, from 50:50 to 80:20 by weight and the content of the disulfonates is in the range from 3 to 13% by weight in the magnesium salt as a whole.

The amount of the above magnesium α-olefinsulfonate is limited to the range from 5 to 40% by weight in the liquid detergent composition of the invention since smaller amounts than 5% by weight lead to decreased detergency while larger amounts than 40% by weight are undesirable due to the increased tendency toward surface film formation.

The component (b) which is an addition product of an alcohol and ethylene oxide is prepared, for example, by the addition reaction of ethylene oxide to an alcohol synthesized by the oxo process or modified oxo process, an alcohol synthesized by use of a Ziegler catalyst, an alcohol derived from a natural oil or fat, an alcohol obtained by a fermentation process, an alcohol which is an oxidation product of a paraffin hydrocarbon and the like, in the presence of an alkali catalyst or an acid catalyst in a ratio of 1 to 20 moles of ethylene oxide added per mole of alcohol when the alcohol is a primary alcohol having 3 to 13 carbon atoms in a molecule or 3 to 15 moles of ethylene oxide added per mole of the alcohol when the alcohol is a secondary alcohol having 9 to 18 carbon atoms. These addition products of an alcohol and ethylene oxide desirably contain not more than 4% by weight of the unreacted alcohol as an impurity since the unpleasant odor of the alcohol may be an impedient in imparting desired fragrance to the liquid detergent composition. The amount of this addition product of alcohol and ethylene oxide in the liquid detergent composition is limited to 1 to 8% or, preferably, 2 to 6% by weight of the composition since smaller amounts than 1% by weight cannot be sufficient in preventing film formation on the surface while larger amounts than 8% by weight lead to decreased detergency and foaming power.

Magnesium sulfate as the component (c) in the inventive liquid detergent composition may be a commercial grade material including crystalline salts having water of crystallization such as $MgSO_4.7H_2O$. The amount of this magnesium sulfate is desirably within the range of 0.2 to 5% by weight as $MgSO_4$ since any amounts outside this range may result in an insufficient effect of preventing film formation on the surface of the liquid detergent composition.

The liquid detergent composition of the present invention is prepared by dissolving the above named components (a), (b) and (c) in an aqueous solvent which is water or a mixed solvent composed of water and a water-soluble organic solvent in concentrations as specified above. This organic solvent is preferably ethyl alcohol and used with the object to decrease the viscosity and to increase the freeze resistance of the liquid detergent composition although it is recommended that the ratio of ethyl alcohol to water is limited to 1:5 by weight or below in order to avoid some disadvantageous effect on the detergency of the composition.

It is also optional that certain additives conventionally employed in liquid detergent compositions are added to the inventive liquid detergent composition including, for example, anionic surface active agents such as alkylbenzenesulfonates having 10 to 18 carbon atoms per alkyl group, alcoholethoxysulfates and the like, amphoteric surface active agents such as alkylbetaines, alkylsulfobetaines and the like, urea, polyethyleneglycol, mono- or diethanolamide of aliphatic carboxylic acids, benzenesulfonates, toluenesulfonates, xylenesulfonates, benzoates, citrates, mono-, di- or triethanolamine, perfumes, coloring agents and the like.

With its markedly reduced tendency toward film formation on the surface combined with a performance as a detergent as high as other detergent compositions, the liquid detergent composition of the present invention is very useful as a dish washing detergent, heavy-duty liquid detergent, shampoo and the like.

In the following, the liquid detergent composition of the present invention is illustrated in further detail by way of examples, in which the tests for various properties of the detergent compositions were carried out in accordance with the procedures given below.

(1) Testing method for the film formation preventing power

Into a sample open beaker of 30 ml capacity and 3.5 cm inner diameter was poured 20 ml of the liquid detergent composition to be tested and left standing at 25° C. for 24 hours in an ambient atmosphere of 70% relative humidity, whereupon the condition of the liquid surface was visually examined and rated in four grades from A to D.

A: no film formation at all on the surface
B: partial film formation on the surface
C: formation of a thin film all over entire surface
D: formation of a thick film all over entire surface (2) Testing Method for Detergency 10 g each of soybean oil and tallow of grades specified in the Japanese Pharmacopoeia were dissolved in 60 ml of chloroform and soiled plates were prepared by dipping glass plates of each 76 mm length, 26 mm width and 1.3 mm thickness into the above solution and removing from the solution followed by air-drying to evaporate the chloroform.

A set of six of the thus prepared soiled glass plates were kept standing in upright positions immersed in 700 ml of a solution containing 0.15% by weight of the test liquid detergent composition under test contained in a vessel as specified in Journal of American Oil Chemists Society, volume 33, page 119 (1956) and stirred with a stirrer rotating at 200 r.p.m. for 3 minutes at 25° C. to partially remove the oily or fatty soiling. After completion of above washing, the glass plates were taken out of the solution, dried and weighed to determine the remaining soiling. The detergency of the detergent composition in % was expressed by the ratio of the amount of removed soiling to the amount of the soil before washing.

(3) Testing Method for Foaming Power

Porcelain dishes of 20 cm diameter each soiled with 0.5 g of butter were washed one by one by rubbing five times for the upper surface and three times for the lower surface with a sponge in 3 liters of the test detergent solution of 0.15% concentration at 25° C. contained in a basin of 30 cm diameter and 12 cm depth to completely remove the butter and the number of the dishes so washed was recorded until the height of the foam on the surface of the detergent solution fell below 1 mm. The height of the foams before washing was about 20 mm.

EXAMPLE 1

Liquid detergent compositions were prepared by blending, in varied proportions as indicated in Table 1 below, a 1:1 by weight mixture of a magnesium α-olefinsulfonate derived from an α-olefin having 14 carbon atoms per molecule and a magnesium α-olefinsulfonate derived from an α-olefin having 16 carbon atoms per molecule, an ethoxylate of butyl alcohol having an average number of moles of the ethylene oxide added to the alcohol (hereinafter referred to as EO $\bar{P}$) equal to 5 and containing 2% by weight of the unreacted butyl alcohol, magnesium sulfate, ethyl alcohol and water and their performance was examined by the testing methods for film formation prevention, detergency and foaming power with the results as set out in Table 1.

As is evident from the results of the comparative experiments given in the table, the omission of or formulation outside the preferred ranges of the alcohol-ethylene oxide addition product or magnesium sulfate results in the film formation over whole surface of the liquid composition. In particular, the omission of the alcohol-ethylene oxide addition product leads to complete loss of the prevention effect of film formation and excessive amounts of the addition product over the preferred range are very deleterious on the prevention of film formation as well as on the detergency of the detergent composition in comparison with the inventive liquid detergent compositions prepared within the preferred formulation having very little tendency toward film formation as well as excellent detergency and foaming power.

EXAMPLE 2

Liquid detergent compositions were prepared by blending, in varied proportions as indicated in Table 2 below, a 2:1 by weight mixture of a magnesium α-olefinsulfonate derived from an α-olefin having 14 carbon atoms per molecule and a magnesium α-olefinsulfonate derived from an α-olefin having 16 carbon atoms per molecule, an addition product of ethylene oxide to mixed alcohols having 9 to 11 carbon atoms per molecule with the value of EO $\bar{P}$ equal to 8 and containing 0.5% by weight of free alcohol, magnesium sulfate, ethyl alcohol and water and their properties were examined in the same manner as in Example 1 with the results set out in Table 2.

below, the same mixture of the magnesium α-olefinsulfonates as used in Example 1, an addition product of ethylene oxide to mixed secondary alcohols having 12 to 14 carbon atoms per molecule with the value of EO $\bar{P}$ equal to 7 and containing 1% by weight of unreacted alcohols, magnesium sulfate, ethyl alcohol and water and their properties were examined in the same manner as in Example 1 with the results set out in Table 3.

EXAMPLE 4

Liquid detergent compositions were prepared by blending, in varied proportions as indicated in Table 4 below, the same mixture of the magnesium α-olefinsulfonates as used in Example 2, an addition product of ethylene oxide to mixed secondary alcohols having 12 to 14 carbon atoms per molecule with the value of EO $\bar{P}$ equal to 12 and containing 0.5% by weight of unreacted alcohol, magnesium sulfate, ethyl alcohol and water and their properties were examined in the same manner as in Example 1 with the results set out in Table 4.

TABLE 1

| Experiment No. | | Formulation of Detergent, % by weight: Magnesium α-olefin-sulfonate | Alcohol-ethylene oxide addition product | Magnesium sulfate | Ethyl alcohol | Water | Results of Testing: Prevention of film formation | Detergency, % | Foaming power, dishes |
|---|---|---|---|---|---|---|---|---|---|
| Present invention | 1 | 25 | 1 | 1 | 5 | Balance | B | 70 | 32 |
| | 2 | 25 | 5 | 1 | 5 | Balance | B | 71 | 33 |
| | 3 | 25 | 8 | 1 | 5 | Balance | B | 69 | 30 |
| | 4 | 25 | 1 | 3 | 5 | Balance | A | 70 | 32 |
| | 5 | 25 | 5 | 3 | 5 | Balance | A | 71 | 33 |
| | 6 | 25 | 8 | 3 | 5 | Balance | B | 69 | 30 |
| Control | 7 | 25 | 0 | 1 | 5 | Balance | D | 70 | 30 |
| | 8 | 25 | 13 | 1 | 5 | Balance | B | 35 | 22 |
| | 9 | 25 | 5 | 0 | 5 | Balance | C | 71 | 33 |
| | 10 | 25 | 5 | 6 | 5 | Balance | C | 71 | 33 |

TABLE 2

| Experiment No. | | Formulation of Detergent, % by weight: Magnesium α-olefin-sulfonate | Alcohol-ethylene oxide addition product | Magnesium sulfate | Ethyl alcohol | Water | Results of Testing: Prevention of film formation | Detergency, % | Foaming power, dishes |
|---|---|---|---|---|---|---|---|---|---|
| Present invention | 11 | 25 | 1 | 1 | 5 | Balance | B | 67 | 30 |
| | 12 | 25 | 5 | 1 | 5 | Balance | B | 68 | 31 |
| | 13 | 25 | 8 | 1 | 5 | Balance | B | 65 | 28 |
| | 14 | 25 | 1 | 3 | 5 | Balance | A | 67 | 30 |
| | 15 | 25 | 5 | 3 | 5 | Balance | A | 68 | 31 |
| | 16 | 25 | 8 | 3 | 5 | Balance | B | 65 | 28 |
| Control | 17 | 25 | 0 | 1 | 5 | Balance | D | 67 | 29 |
| | 18 | 25 | 13 | 1 | 5 | Balance | B | 32 | 20 |
| | 19 | 25 | 5 | 0 | 5 | Balance | C | 68 | 31 |
| | 20 | 25 | 5 | 6 | 5 | Balance | C | 68 | 31 |

EXAMPLE 3

Liquid detergent compositions were prepared by blending, in varied proportions as indicated in Table 3

TABLE 3

| Experiment No. | | Formulation of Detergent, % by weight: Magnesium α-olefin-sulfonate | Alcohol-ethylene oxide addition product | Magnesium sulfate | Ethyl alcohol | Water | Results of Testing: Prevention of film formation | Detergency, % | Foaming power, dishes |
|---|---|---|---|---|---|---|---|---|---|
| Present invention | 21 | 25 | 1 | 1 | 5 | Balance | B | 70 | 31 |
| | 22 | 25 | 5 | 1 | 5 | Balance | A | 70 | 32 |
| | 23 | 25 | 8 | 1 | 5 | Balance | B | 67 | 28 |
| | 24 | 25 | 1 | 3 | 5 | Balance | A | 70 | 31 |

TABLE 3-continued

| Experiment No. | | Formulation of Detergent, % by weight: Magnesium α-olefin-sulfonate | Alcohol-ethylene oxide addition product | Magnesium sulfate | Ethyl alcohol | Water | Results of Testing: Prevention of film formation | Detergency, % | Foaming power, dishes |
|---|---|---|---|---|---|---|---|---|---|
| | 25 | 25 | 5 | 3 | 5 | Balance | A | 70 | 32 |
| | 26 | 25 | 8 | 3 | 5 | Balance | B | 67 | 28 |
| Control | 27 | 25 | 0 | 1 | 5 | Balance | D | 70 | 30 |
| | 28 | 25 | 13 | 1 | 5 | Balance | B | 32 | 21 |
| | 29 | 25 | 5 | 0 | 5 | Balance | C | 70 | 32 |
| | 30 | 25 | 5 | 6 | 5 | Balance | C | 70 | 32 |

TABLE 4

| Experiment No. | | Formulation of Detergent, % by weight: Magnesium α-olefin-sulfonate | Alcohol-ethylene oxide addition product | Magnesium sulfate | Ethyl alcohol | Water | Results of Testing: Prevention of film formation | Detergency, % | Foaming power, dishes |
|---|---|---|---|---|---|---|---|---|---|
| Present | 31 | 25 | 1 | 1 | 5 | Balance | B | 69 | 30 |
| invention | 32 | 25 | 5 | 1 | 5 | Balance | A | 69 | 31 |
| | 33 | 25 | 8 | 1 | 5 | Balance | B | 66 | 28 |
| | 34 | 25 | 1 | 3 | 5 | Balance | A | 69 | 30 |
| | 35 | 25 | 5 | 3 | 5 | Balance | A | 69 | 31 |
| | 36 | 25 | 8 | 3 | 5 | Balance | B | 66 | 28 |
| Control | 37 | 25 | 0 | 1 | 5 | Balance | D | 69 | 30 |
| | 38 | 25 | 13 | 1 | 5 | Balance | B | 31 | 21 |
| | 39 | 25 | 5 | 0 | 5 | Balance | C | 69 | 31 |
| | 40 | 25 | 5 | 6 | 5 | Balance | C | 69 | 31 |

EXAMPLE 5

Dish washing detergents, heavy-duty liquid detergents and shampoos were prepared by dissolving the same mixture of the magnesium α-olefinsulfonates as used in Example 2, either one or both of the addition products of ethylene oxide to alcohols used in Examples 2 and 3 and magnesium sulfate into water or a mixed solvent of water and ethyl alcohol in proportions as indicated in Table 5 together with certain additives also given in the table in % by weight, the balance in the table being water, and their properties were examined in the same manner as in Example 1. It was found that all of these detergent compositions were excellent in preventing film formation, being rated as grade A in the above-given criteria with the detergency and foaming power as good as in Examples 1 to 4.

TABLE 5

| Type of detergent | Dish washing detergent | | | | | | | | | | Heavy-duty liquid detergent | | Shampoo | |
|---|---|---|---|---|---|---|---|---|---|---|---|---|---|---|
| Experiment No. | 41 | 42 | 43 | 44 | 45 | 46 | 47 | 48 | 49 | 50 | 51 | 52 | 53 | 54 |
| Magnesium α-olefinsulfonate[c] | 15 | 15 | 15 | 15 | 25 | 20 | 15 | 10 | 10 | 25 | 30 | 25 | 14 | 10 |
| LAS-Mg[a] | 0 | 10 | 0 | 10 | 0 | 0 | 0 | 10 | 10 | 0 | 0 | 0 | 0 | 0 |
| LES-Mg[b] | 10 | 0 | 10 | 0 | 0 | 5 | 10 | 5 | 5 | 0 | 7 | 15 | 0 | 4 |
| Alcohol-ethylene oxide addition product (I)[c] | 5 | 5 | 0 | 0 | 3 | 4 | 0 | 5 | 3 | 3 | 8 | 3 | 2 | 0 |
| Alcohol-ethylene oxide addition product (II)[d] | 0 | 0 | 5 | 5 | 0 | 0 | 5 | 0 | 2 | 3 | 0 | 3 | 0 | 2 |
| Magnesium sulfate | 2 | 2 | 2 | 2 | 2.5 | 2.5 | 2 | 2 | 2 | 2.5 | 2.0 | 2.0 | 1.5 | 1.5 |
| Ethyl alcohol | 3 | 5 | 3 | 5 | 4 | 4 | 4 | 5 | 3 | 5 | 5 | 4 | 0 | 0 |
| Urea | 0 | 0 | 0 | 0 | 4 | 4 | 3 | 0 | 0 | 0 | 0 | 0 | 0 | 0 |
| Triethanolamine | 0 | 0 | 0 | 0 | 0 | 0 | 0 | 0 | 0 | 0 | 2.0 | 0 | 0 | 0 |
| Diethanolamide of coconut oil fatty acid | 0 | 0 | 0 | 0 | 0 | 0 | 0 | 0 | 0 | 0 | 0 | 0 | 3 | 3 |

[a]Magnesium linear-alkylbenzenesulfonate where the alkyl groups have 10 to 14 carbon atoms.
[b]Magnesium alkylpolyoxyethylene ether sulfate with the value of EO P equal to 3 where the alkyl groups have 12 to 13 carbon atoms.
[c]The same as used in Example 2.
[d]The same as used in Example 3.

What is claimed is:

1. A liquid detergent composition consisting essentially of:

(a) water (b) from 5 to 40% by weight of a magnesium α-olefinsalfonate having from 10 to 20 carbon atoms, (c) from 1 to 8% by weight of an addition product of a primary alcohol having from 3 to 13 carbon atoms with an average of from 1 to 20 moles of ethylene oxide per mole of said primary alcohol, or an addition product of a secondary alcohol having from 9 to 18 carbon atoms with an average of from 3 to 15 moles of ethylene oxide per mole of said secondary alcohol, and (d) from 0.2 to 5% by weight of magnesium sulfate, said constituents b, c and d being in dissolved form and the weight thereof being by weight of the composition.

2. The liquid detergent composition as claimed in claim 1 wherein said magnesium α-olefinsulfonate has an average of from 13.5 to 16.0 carbon atoms, with from 25 to 75% of the same having 14 carbon atoms.

3. The liquid detergent composition as claimed in claim 1 wherein the amount of the component (c) in said detergent composition is in the range from 2 to 6% by weight.

4. The liquid detergent composition as claimed in claim 1 further comprising ethyl alcohol in a weight ratio to said water of 1.5 or less.

* * * * *